US008118138B2

(12) United States Patent
Aulanko et al.

(10) Patent No.: US 8,118,138 B2
(45) **Date of Patent: *Feb. 21, 2012**

(54) METHOD FOR INSTALLING AN ELEVATOR

(75) Inventors: Esko Aulanko, Kerava (FI); Jorma Mustalahti, Hyvinkää (FI); Osmo Björni, Hyvinkää (FI); Teuvo Väntänen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 11/393,896

(22) Filed: Mar. 31, 2006

(65) Prior Publication Data

US 2006/0243530 A1 Nov. 2, 2006

Related U.S. Application Data

(63) Continuation of application No. PCT/FI2004/000662, filed on Nov. 9, 2004.

(30) Foreign Application Priority Data

Nov. 17, 2003 (FI) ..... 20031664
Mar. 18, 2004 (FI) ..... 20040422

(51) Int. Cl.
*B66B 7/10* (2006.01)
*B66B 19/00* (2006.01)
*B66B 11/08* (2006.01)
*B23P 11/00* (2006.01)
*E04G 21/00* (2006.01)

(52) U.S. Cl. ..... 187/264; 187/254; 187/266; 187/900; 29/429; 52/741.1

(58) Field of Classification Search ..... 187/254, 187/266, 401, 900, 256, 264; 29/428–429; 52/30, 745.02, 745.04, 745.19, 745.2, 741.1; *B66B 11/08*

See application file for complete search history.

(56) References Cited

U.S. PATENT DOCUMENTS 12,640 A 4/1855 Murtaugh (Continued)

FOREIGN PATENT DOCUMENTS

DE 25 06 670 10/1975

(Continued)

OTHER PUBLICATIONS

International Search Report (PCT/ISA/210 and PCT/ISA/220).

(Continued)

*Primary Examiner* — Michael Mansen
*Assistant Examiner* — Stefan Kruer
(74) *Attorney, Agent, or Firm* — Harness, Dickey & Pierce, P.L.C.

(57) ABSTRACT

A method for installing an elevator may include stopping an elevator car or partially completed elevator car in the upper part of an elevator shaft; rigging first portions of hoisting ropes between the car and diverting pulleys in the upper part of the shaft so that the first portions pass via the diverting pulleys in the upper part of the shaft and first diverting pulleys on the car; moving the car to the lower part of the shaft, while supplying ropes from rope reels to the first portions between the car and the diverting pulleys in the upper part of the shaft; and rigging second portions of the hoisting ropes between the car and diverting pulleys in the lower part of the shaft so that the second portions pass via the diverting pulleys in the lower part of the shaft and second diverting pulleys on the car.

22 Claims, 7 Drawing Sheets

U.S. PATENT DOCUMENTS

| | | | | | |
|---|---|---|---|---|---|
| 216,568 | A | * | 6/1879 | Holske | 187/251 |
| 3,298,462 | A | * | 1/1967 | Morris | 187/262 |
| 3,851,736 | A | * | 12/1974 | Westlake et al. | 52/745.2 |
| 4,231,148 | A | | 11/1980 | Harding | |
| 4,345,671 | A | | 8/1982 | Tosato et al. | |
| 4,502,570 | A | | 3/1985 | Westerlund | |
| 5,000,292 | A | | 3/1991 | Chapelain et al. | |
| 5,014,822 | A | * | 5/1991 | Chapelain et al. | 187/408 |
| 5,065,843 | A | * | 11/1991 | Richards | 187/408 |
| 5,553,686 | A | * | 9/1996 | Jensen | 187/408 |
| 5,944,144 | A | * | 8/1999 | Hein | 187/254 |
| 6,193,017 | B1 | * | 2/2001 | Koster | 187/258 |
| 6,234,276 | B1 | * | 5/2001 | Wagatsuma et al. | 187/411 |
| 6,425,463 | B1 | * | 7/2002 | Broyan | 187/411 |
| 6,446,763 | B1 | | 9/2002 | Glassey et al. | |
| 6,471,012 | B2 | * | 10/2002 | Faletto | 187/256 |
| 6,491,136 | B2 | * | 12/2002 | Kobayashi et al. | 187/254 |
| 6,533,077 | B1 | * | 3/2003 | Glassey | 187/411 |
| 6,672,013 | B1 | * | 1/2004 | Glassey et al. | 52/30 |
| 7,207,421 | B2 | * | 4/2007 | Aulanko et al. | 187/266 |
| 7,481,299 | B2 | * | 1/2009 | Mustalahti et al. | 187/264 |
| 7,481,300 | B2 | * | 1/2009 | Aulanko et al. | 187/266 |
| 7,484,596 | B2 | * | 2/2009 | Aulanko et al. | 187/266 |
| 7,562,744 | B2 | * | 7/2009 | Mustalahti et al. | 187/254 |
| 7,650,972 | B2 | * | 1/2010 | Aulanko et al. | 187/350 |
| 7,802,658 | B2 | * | 9/2010 | Aulanko et al. | 187/266 |
| 8,020,670 | B2 | * | 9/2011 | Mustalahti et al. | 187/264 |
| 2002/0066622 | A1 | | 6/2002 | Pettersson et al. | |
| 2005/0217944 | A1 | * | 10/2005 | Aulanko et al. | 187/266 |
| 2005/0224301 | A1 | * | 10/2005 | Aulanko et al. | 187/406 |
| 2005/0284705 | A1 | * | 12/2005 | Aulanko et al. | 187/266 |
| 2006/0231347 | A1 | * | 10/2006 | Mustalahti et al. | 187/266 |
| 2006/0243530 | A1 | | 11/2006 | Aulanko et al. | |
| 2006/0243531 | A1 | * | 11/2006 | Bjorni et al. | 187/260 |
| 2006/0243532 | A1 | * | 11/2006 | Aulanko et al. | 187/266 |
| 2007/0017750 | A1 | * | 1/2007 | Mustalahti et al. | 187/254 |

FOREIGN PATENT DOCUMENTS

| | | | | |
|---|---|---|---|---|
| EP | 0375208 | | | 6/1990 |
| EP | 0631967 | | | 1/1995 |
| EP | 0631968 | | | 1/1995 |
| EP | 0 375 208 | | | 6/1997 |
| EP | 1380532 | A1 | | 1/2004 |
| FR | 2823734 | A1 | * | 10/2002 |
| FR | 2921913 | A1 | * | 4/2009 |
| GB | 1 442 584 | | | 7/1976 |
| JP | 58-41275 | | | 9/1983 |
| JP | 1-261189 | | | 10/1989 |
| JP | 2-225280 | | | 7/1990 |
| JP | 2513183 | | | 7/1996 |
| JP | 2000-247560 | A | | 9/2000 |
| JP | 2001-302139 | | | 10/2001 |
| JP | 2003128359 | | | 5/2003 |
| WO | 98/06655 | | | 2/1998 |
| WO | WO 01/44096 | A1 | | 6/2001 |
| WO | 2004/041701 | | | 5/2004 |
| WO | WO 2004067429 | A1 | * | 8/2004 |
| WO | WO 2005090217 | A2 | * | 9/2005 |

OTHER PUBLICATIONS

US Office Action dated Feb. 1, 2011, issued in Co-Pending U.S. Appl. No. 11/407,889.

Finnish Search Report from FI 20031664 dated Jul. 20, 2004.

Japanese Office Action dated Nov. 9, 2010 issued in corresponding Japanese Application No. 2006-540475 (English translation only).

U.S. Office Action for U.S. Appl. No. 11/407,889 dated Nov. 28, 2007.

U.S. Office Action for U.S. Appl. No. 11/407,889 dated Jan. 9, 2009.

U.S. Office Action for U.S. Appl. No. 11/407,889 dated Mar. 2, 2010.

U.S. Office Action for U.S. Appl. No. 11/407,889 dated Mar. 19, 2007.

U.S. Office Action for U.S. Appl. No. 11/407,889 dated Jul. 11, 2008.

U.S. Office Action for U.S. Appl. No. 11/407,889 dated Jun. 9, 2009.

U.S. Office Action for U.S. Appl. No. 11/407,889 dated Aug. 31, 2010.

Notice of Allowance for U.S. Appl. No. 11/505,976 dated Mar. 16, 2009.

U.S. Office Action for U.S. Appl. No. 11/505,976 dated Apr. 30, 2008.

U.S. Office Action for U.S. Appl. No. 11/505,976 dated Dec. 10, 2007.

U.S. Office Action for U.S. Appl. No. 11/505,976 dated May 22, 2007.

U.S. Office Action for U.S. Appl. No. 11/505,976 dated Aug. 21, 2008.

* cited by examiner

METHOD FOR INSTALLING AN ELEVATOR

CROSS-REFERENCE TO RELATED APPLICATIONS

This application is a continuation of International Application No. PCT/FI2004/000662, filed on Nov. 9, 2004 (also known as World Intellectual Property Organization International Publication No. WO 2005/047164 A3), in the Receiving Office of the National Board of Patents and Registration of Finland ("NBPRF"), and claims the benefit of that application under 35 U.S.C. §365(c). In turn, that application claims the right of priority under 35 U.S.C. §365(b) of Finnish Patent Application No. 20040422, filed on Mar. 18, 2004, in the NBPRF, and Finnish Patent Application No. 20031664, filed on Nov. 17, 2003, in the NBPRF.

BACKGROUND

1. Field

The present invention relates to a method for installing an elevator and to an elevator installed according to the method.

2. Description of Related Art

One of the objectives in elevator development work is to achieve an efficient and economical utilization of building space. In recent years, this development work has produced various elevator solutions without machine room, among other things. Good examples of elevators without machine room are disclosed in specifications EP 0 631 967 (A1) and EP 0 631 968. The elevators described in these specifications are fairly efficient in respect of space utilization as they have made it possible to eliminate the space required by the elevator machine room in the building without a need to enlarge the elevator shaft. In the elevators disclosed in these specifications, the machine is compact at least in one direction, but in other directions it may have much larger dimensions than a conventional elevator machine.

In these basically good elevator solutions, the space required by the hoisting machine limits the freedom of choice in elevator lay-out solutions. Some space is needed to provide for the passage of the hoisting ropes. It is difficult to reduce the space required by the elevator car itself on its track and likewise the space required by the counterweight, at least at a reasonable cost and without impairing the performance and operational quality of the elevator. In the case of a traction sheave elevator without machine room, mounting the hoisting machine in the elevator shaft is difficult, especially in a solution with machine above, because the hoisting machine is a sizeable body of considerable weight. Especially in the case of larger loads, speeds and/or hoisting heights, the size and weight of the machine are a problem regarding installation, even so much so that the required machine size and weight have in practice limited the sphere of application of the concept of elevator without machine room or at least retarded the introduction of said concept in larger elevators. In modernization of elevators, the space available in the elevator shaft has often limited the sphere of application of the concept of elevator without machine room. Often, especially when hydraulic elevators have had to be modernized or replaced, it has not been practical to apply a roped elevator solution without machine room due to insufficient space in the elevator shaft, particularly when no counterweight has been used in the hydraulic elevator solution to be modernized/replaced. The drawbacks of elevators with counterweight are the cost of the counterweight and the space required for the counterweight in the elevator shaft. Drum driven elevators, which are nowadays rather seldom installed, have the drawbacks of heavy and complicated hoisting machines and their large power and/or torque requirement. Prior-art elevators without counterweight are exotic and no proper solutions are known. So far it has not been technically or economically reasonable to make elevators without counterweight. One solution like this is disclosed in specification WO9806655. The recent international patent application PCT/FI03/00818 discloses a feasible elevator solution without counterweight differing from prior-art solutions. In prior-art elevator solutions without counterweight, the tensioning of the hoisting rope is implemented using a weight or spring, and that is not an attractive approach to implementing the tensioning of the hoisting rope. Another problem with elevators without counterweight, when long ropes are used e.g. due to a large hoisting height or large suspension ratios used, the compensation of rope elongations and at the same time the friction between the traction sheave and the hoisting ropes is insufficient for the operation of the elevator. In the case of a hydraulic elevator, especially a hydraulic elevator with lifting power applied from below, the shaft efficiency, i.e. the ratio of the cross-sectional shaft area taken up by the elevator car to the total cross-sectional area of the elevator shaft, is fairly high. This has traditionally been a significant reason why expressly a hydraulic elevator has been selected for a building. On the other hand, hydraulic elevators have many drawbacks related to their lifting principle and use of oil. Hydraulic elevators have high energy consumption, a possible leakage of oil from the equipment is an environmental hazard, the periodically required oil change involves a high cost, even an elevator installation in good condition causes olfactory disadvantages as small amounts of oil escape into the elevator shaft or machine room and from there further to other parts of the building and into the environment and so on. Due to the shaft efficiency of a hydraulic elevator, modernization of the elevator by replacing it with another type of elevator that would allow the drawbacks of the hydraulic elevator to be avoided but would necessitate the use of a smaller elevator car is not an attractive solution to the owner of the elevator. Hydraulic elevators also have small machine spaces, which may be located at a distance from the elevator shaft, making it difficult to change the elevator type.

There are very large numbers of traction sheave elevators installed and in use. They were made at their time to meet the proposed needs of users and the intended uses of the buildings concerned. Later, both user needs and the practical requirements of the buildings have changed in many cases and an old traction sheave elevator may have become insufficient in respect of size of the elevator car or in other respects. For example, older elevators of a rather small size are not necessarily suited for transporting perambulators or roller chairs. On the other hand, in older buildings that have been converted from residential use to office or other use, the originally installed smaller elevator is no longer sufficient in capacity. As is known, increasing the size of such a traction sheave elevator is practically impossible because the elevator car and counterweight already fill the cross-sectional area of the elevator shaft and the car can not be reasonably enlarged.

SUMMARY

The general aim of the invention is to achieve at least one the following objectives. An objective of the invention is develop the elevator without machine room so as to achieve more efficient space utilization in the building and in the elevator shaft than before. This means that the elevator should permit of being installed in a relatively narrow elevator shaft if necessary. One objective is to achieve an elevator in which the elevator hoisting rope has a good hold/grip on the traction sheave. A further objective of the invention is to create an elevator solution without counterweight without compromising on the properties of the elevator. It is also an objective to eliminate the undesirable effects of rope elongations. An additional objective of the invention is to achieve a more efficient utilization of the elevator shaft spaces above and below the elevator car than before in the case of elevators without counterweight. A specific objective is to create an effective method of installing a traction sheave elevator without counterweight in an elevator shaft. It is also an objective to reduce the labor input and time required for the actual installation.

The objective or objectives of the invention should be achieved without compromising on the possibility of varying the basic layout of the elevator.

The method of the invention is discussed below. Some embodiments of the invention are characterized by what is disclosed in the claims. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. The features of different embodiments and applications of the invention may also be combined in other ways in addition to those described here. Some of the attributes contained in the claims below may be superfluous from the point of view of separate inventive concepts. The invention can also be regarded as an arrangement whereby an elevator is delivered or as a way of configuring an elevator and/or elevator installation work. The elevator achieved by the invention can also be considered as an assembly containing certain structures and not only as a result of the installation method.

By applying the invention, one or more of the following advantages, among others, can be achieved:

- the invention enables a simple manner of installing an elevator while also reducing the installation time; the installation time is shortened and the total installation costs are reduced
- the roping of the elevator, i.e. the mounting of the hoisting ropes of the elevator on the rope pulleys of the elevator can be implemented without very long distances between successive rope pulleys, thus allowing faster installation and preventing installation errors
- so-called "one-man installation" becomes possible for a significant portion of the installation time or even for the entire installation work, so the progress of the installation work is not retarded by waiting times incurred when several persons are working together; a saving on installation time of up to one third can be achieved; work safety is improved as the working time in the elevator shaft is reduced
- as the diverting pulleys in the upper part of the shaft and the machine are mounted on the guide rails, no separate steel structures reducing the shaft space above the elevator car need to be provided at the upper end of the elevator shaft
- by applying the invention, efficient utilization of the cross-sectional area of the shaft is achieved
- installation in the shaft is easy because a module comprising car structures, e.g. car frame and/or car ceiling and/or car floor, as well as the rope pulleys for the upper part of the shaft, the rope pulleys for the lower part of the shaft and the rope pulleys of the elevator car, preferably also the hoisting machine, can be brought into the shaft via a shaft door opening by using a pump hoist truck or equivalent or via the shaft ceiling by means of a hoist
- although the invention primarily intended for use in elevators without machine room, it can also be applied for use in elevators with machine room, in which case the hoisting ropes have to be passed separately via the hoisting machine in the machine room or the traction sheave of the hoisting machine has to be arranged to be mounted in the elevator shaft
- Preferable suspension ratios above and below the elevator car are 2:1, 6:1, 10:1 and so on. Other suspension ratios may also be used, e.g. 8:1 or other even ratios. In rope suspension, if the end of the hoisting ropes is attached to the elevator car, the suspension ratio may be an odd ratio, e.g. 7:1 or 9:1.
- Symmetrical suspension of the elevator car relative to the elevator shaft is easily achieved at least in the preferred embodiments of the invention.

The primary area of application of the invention is elevators designed for transporting people and/or freight. A normal area of application of the invention is in elevators whose speed range is about or below 1.0 m/s but may also be higher. For example, an elevator traveling at a speed of 0.6 m/s is easy to implement according to the invention.

In the elevator of the invention, normal elevator ropes, such as generally used steel wire ropes, are applicable. The elevator may use ropes of synthetic material and rope structures with a synthetic-fiber load-bearing part, such as e.g. so-called "aramid" ropes, which have recently been proposed for use in elevators. Applicable solutions are also steel-reinforced flat belts, especially because of the small deflection radius they permit. Particularly advantageously applicable for use in the elevator of the invention are elevator hoisting ropes twisted from e.g. round and strong wires. In this way it is possible to achieve thinner ropes and, due to the smaller rope thicknesses, also smaller diverting pulleys and drive sheaves. Using round wires, the rope can be twisted in many ways using wires of the same or different thicknesses. In ropes well applicable with the invention, the wire thickness is below 0.4 mm on an average. Well-suited ropes made from strong wires are those in which the average wire thickness is under 0.3 mm or even under 0.2 mm. Applicable for use in the invention are thin ropes of a thickness under 8 mm, preferably ropes of a thickness between 3 mm . . . 6 mm, e.g. 4 mm or 5 mm, made from wires that are stronger than those conventionally used at present in the most strong-wired elevator hoisting ropes, so the ropes should have a strength exceeding 1770 N/mm$^2$. The advantages of thin and strong wires are already obvious in ropes made from wires having a strength of about 2000 N/mm$^2$ or more, which allows a sufficient load-bearing capacity of the hoisting ropes to be achieved with a reasonable number of parallel hoisting ropes and a reasonable width of the set of hoisting ropes. Appropriate rope wire strengths are 2100-2700 N/mm$^2$. In principle, it is possible to use rope wires of a strength of about 3000 N/mm$^2$ or even more. In practice, a rope with a wire strength of about 2100 N/mm$^2$ is chosen rather than a rope with a very much greater wire strength, e.g. about 3000 N/mm$^2$, because a stronger rope is generally more expensive and its quality can not necessarily be as easily standardized as the quality of a less strong rope. A significant factor in this context is whether a sufficient load-bearing capacity of the hoisting ropes is achieved in relation to the width of the set of hoisting ropes.

By increasing the contact angle using a rope pulley functioning as a diverting pulley, the grip between the traction sheave and the hoisting ropes can be improved. A contact angle of over 180° between the traction sheave and the hoisting rope is achieved by using a diverting pulley or diverting pulleys. In this way, a lighter car of a reduced weight can be used, thus increasing the space-saving potential of the elevator.

The elevator applying the invention is preferably an elevator without counterweight and with an elevator car guided by guide rails and suspended by means of diverting pulleys on a set of hoisting ropes in such manner that that the set of hoisting ropes of the elevator comprises rope portions going upwards and downwards from the elevator car. The elevator comprises a number of diverting pulleys in the upper and lower parts of the elevator shaft. The elevator has a drive machine provided with a traction sheave and placed in the elevator shaft. The elevator comprises a compensating device acting on the hoisting ropes to equalize and/or compensate the rope tension and/or rope elongation. The diverting pulleys are preferably mounted on the elevator car near the two side walls.

According to the invention, the delivery and installation of the elevator may proceed as follows:

1. Referring to FIG. 8, at 100, a rope for a hoist is mounted in the elevator shaft e.g. by fastening to the ceiling a pulley block to which the rope is passed, and a hoisting device suited for the installation work is introduced to drive the rope.

2. At 101, an overspeed governor—safety gear system is installed in the shaft so that the elevator car to be installed or a part of it that is going to be used in the installation work can be protected against uncontrolled movement already during the installation work.

3. At 102, plumb lines, laser sources, preferably two, or similar devices to be used for checking the straightness of the shaft and in the installation and alignment of the car guide rails are mounted in the shaft.

4. At 103, the lowest car guide rail sections are installed and aligned into position.

5. At 104, on the first installed guide rail sections are placed the car on buffers, a frame supporting the car and also functioning as safety gear frame, or in the case of a self-supporting car at least a beam or beams to which the diverting pulleys placed on the car are to be mounted. Preferably a solution is used wherein the car frame or other car-supporting structure is clearly lower than it will be in the finished elevator; for example, the car frame may be a telescopic structure. During installation, the mutual positions of the car an guide rails is controlled by means of conventional sliding or roller guides mounted on the car/car frame.

6. At 105, the diverting pulleys needed on the car are mounted on the car frame or other car part installed on the guide rails and, using temporary support blocks or by other means, the diverting pulleys to be installed at the upper end of the elevator shaft, and preferably the elevator hoisting machine as well, are also fastened to the said car frame or other part.

7. At 106, using the hoist, a hoisting operation is performed by hoisting by the upper part of the car frame or by the beam structure at the upper part of the car so that the preferably telescopically constructed car frame is stretched/the top beam of the car comes to a sufficient height, preferably to a height that, in respect of the construction of the car, corresponds to the final car height from the structure of the lower part of the car/car frame to allow the car to be constructed. At 107, the beam of the upper part of the car frame/car is firmly secured to the lower part of the car frame/car, using a fastening arrangement either final or temporary in respect of installation of the elevator. In the case of a car frame, it is preferable to lock the telescoping car frame to its final height at this stage, whereas in the case of a self-supporting car the top beam of the car and a working surface in the lower part of the car, e.g. the car floor can be fastened together by the car walls or by other means, e.g. with temporary beams or tension bars. Also at 107, the car floor is preferably installed, both in the case of a car with a car frame and in the case of a self-supporting car construction. To the structure thus obtained are fastened boxes or holders on which the car guide rails are carried along. In an installation with a car frame, conventional rubber insulators or other suitable vibration insulating elements are placed between the car floor and the car frame.

8. At 108, the car walls are installed, preferably starting from the back wall. The walls and the floor preferably constitute in themselves a structure relatively rigid against torsion, but if necessary the structure can be stiffened by means of separate reinforcing elements.

9. At 109, the ceiling of the car is mounted in place, preferably by a final arrangement, thus making the car itself quite stiff, so it will be well able to withstand-all the stress it is subjected to during installation and subsequent operation.

10. At 111, the overspeed governor—safety gear system is activated in its function of controlling the motion of the car.

11. At 112, an installation-time safety device acting on the safety gear or other means locking the elevator car to the guide rails is added to the elevator. The installation-time safety device may be automatic, such that whenever the rope of the hoist used to lift the elevator car becomes loose or the force supporting the elevator car falls below a certain limit, the safety device causes the car to be immovably locked to the guide rail. The safety device may be a pedal or other coupling means that is used by the installer to keep the safety gear or other safety device in a state permitting movement of the elevator as he/she is driving the elevator by means of the hoist, and at other times the safety device automatically prevents movement of the elevator car.

12. At 113, in a preferable case, all the guide rails are loaded onto the car and the installation of the car guide rails is started by installing new guide rails above those already installed, using the elevator car as a working platform and raising the elevator upwards car by means of the hoist as the installation work is progressing.

13. Also at 113, the guide rails are aligned with the help of laser beams and/or other means conventionally used for the alignment of guide rails.

14. At 114, when the upper end of the shaft is reached, the diverting pulleys brought on the car for the upper part of the shaft are mounted in the upper part of the shaft, preferably on diverting pulley supporters secured to the upper part of the elevator guide rails. The drive machine of the elevator is also preferably mounted on a guide rail. The drive machine and at least one of the diverting pulleys may have a common supporter by which they are supported on the guide rail. If necessary, a suitable hoist or other hoisting tool is utilized.

15. At 115, once the pulleys in the upper part have been secured in place, the ropes needed between the diverting pulleys in the upper part of the shaft and the up-direction diverting pulleys of the elevator car are rigged and the rope ends are secured as necessary.

16. At 116. the elevator car is lowered while at the same time dispensing more rope from rope reels, the length of the rope portions between the car and the upper part of the shaft thus correspondingly increasing.

17. At 117, once the elevator car has descended to a suitable height in the lower part of the shaft, the diverting pulleys for the lower part of the shaft are released from the elevator car from their temporary mounting and mounted on the lower part of the elevator car. The diverting pulleys for the lower part of the elevator shaft may also have been secured to the lower part of the elevator shaft earlier, especially if they were not already secured to the elevator car structure when delivered to the site of installation.

18. At 118, in the lower part of the elevator shaft, the rope portions of the hoisting ropes between the down-direction diverting pulleys of the elevator car and the diverting pulleys mounted in the lower part of the shaft are rigged.

19. At 119, the equipment equalizing rope forces and compensating rope elongations is installed so that it will act on the ropes unless this has already been done, and the ends of the ropes in the set of ropes are secured to the positions determined by the roping diagram.

The installation work will not necessarily follow the above-described procedure in all the various stages of installation and/or not all the stages of installation are necessary, at least quite in the form described above. For example, the ropes in the installation may have been rigged previously on some of the diverting pulleys of the elevator, in which case the rest of the diverting pulleys have to be rigged during installation. Likewise, the stages of installation differ if the rope portions below the elevator car are rigged first and only then the rope portions above the elevator car, in which case, instead of increasing the length of the rope portions above the elevator car as the elevator car is moved, the length of the rope portions below the elevator car is increased, supplying more rope from the rope reels into the roping arrangement. When a new elevator is installed in place of an old one but the old guide rails are used, the installation of guide rails would be left out completely from the stages of the method.

In simplified terms it could be stated that, in installing an elevator without counterweight, the main components of the elevator are at first installed on the bottom of the shaft between the first guide rails, in which case the two first guide rail sections, typically of a length of a few meters, preferably equal to about one floor-to-floor height or distance. Often the guide rails are delivered in sections of a length of about five meters, which are then joined together during installation to form a guide rail line extending from the lower part of the elevator shaft to its upper part. In less spacious environments shorter guide rail sections of length of about 2½ meters are easier to handle. Between the first guide rails is assembled a car supporting frame, a safety gear frame, an elevator car or equivalent, which is used as an "installation tool" and/or as an installation carriage, to which are secured in a temporary manner the diverting pulleys of the car as well as the hoisting machine together with the associated equipment. After the ropes have been installed, the hoisting ropes are rigged on the rope pulleys first at one end of the shaft, whereupon the ropes already rigged are "stretched" by moving the elevator car to the other end of the shaft, where the rigging of the hoisting ropes for this other end is performed.

BRIEF DESCRIPTION OF THE DRAWINGS

In the following, the invention will be described in detail with reference to a few embodiment examples and the attached drawings, wherein.

DETAILED DESCRIPTION OF EXAMPLE EMBODIMENTS

Figure 1:
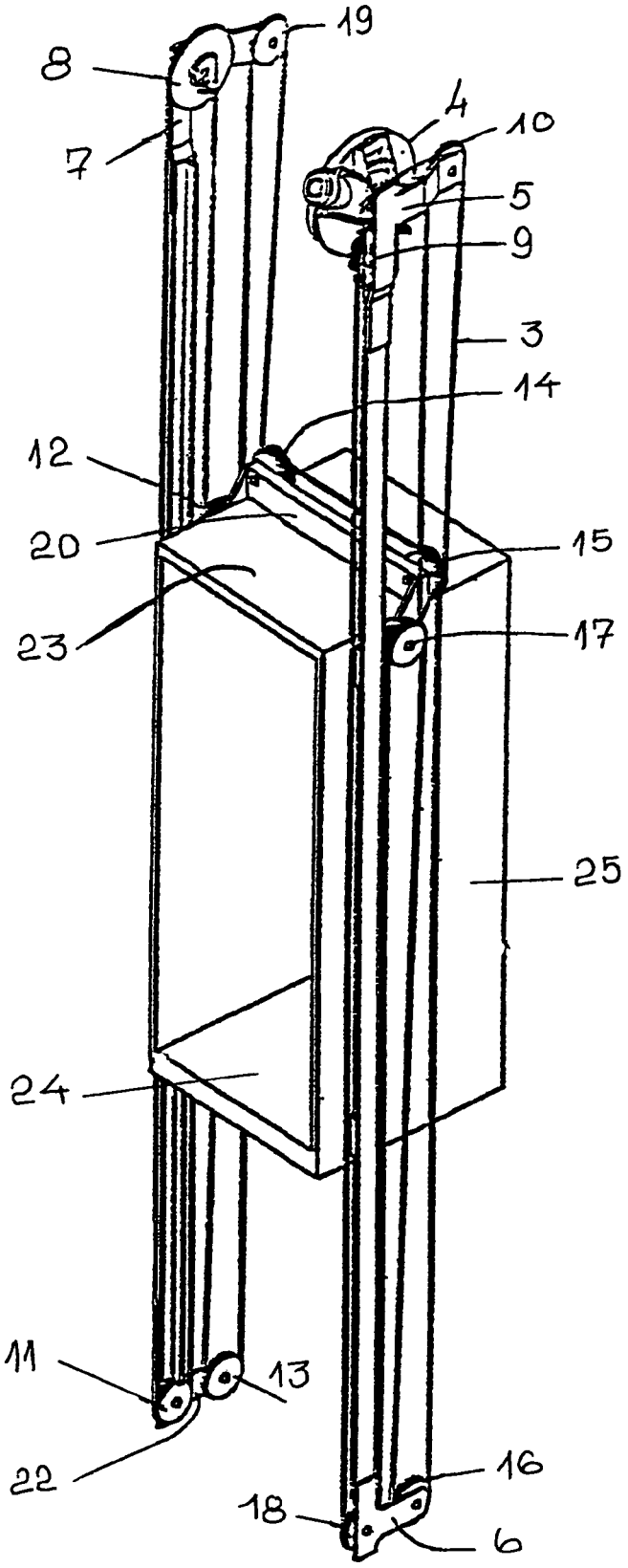
FIG. 1 is a diagram representing an elevator achieved by the invention.
Figure 2:
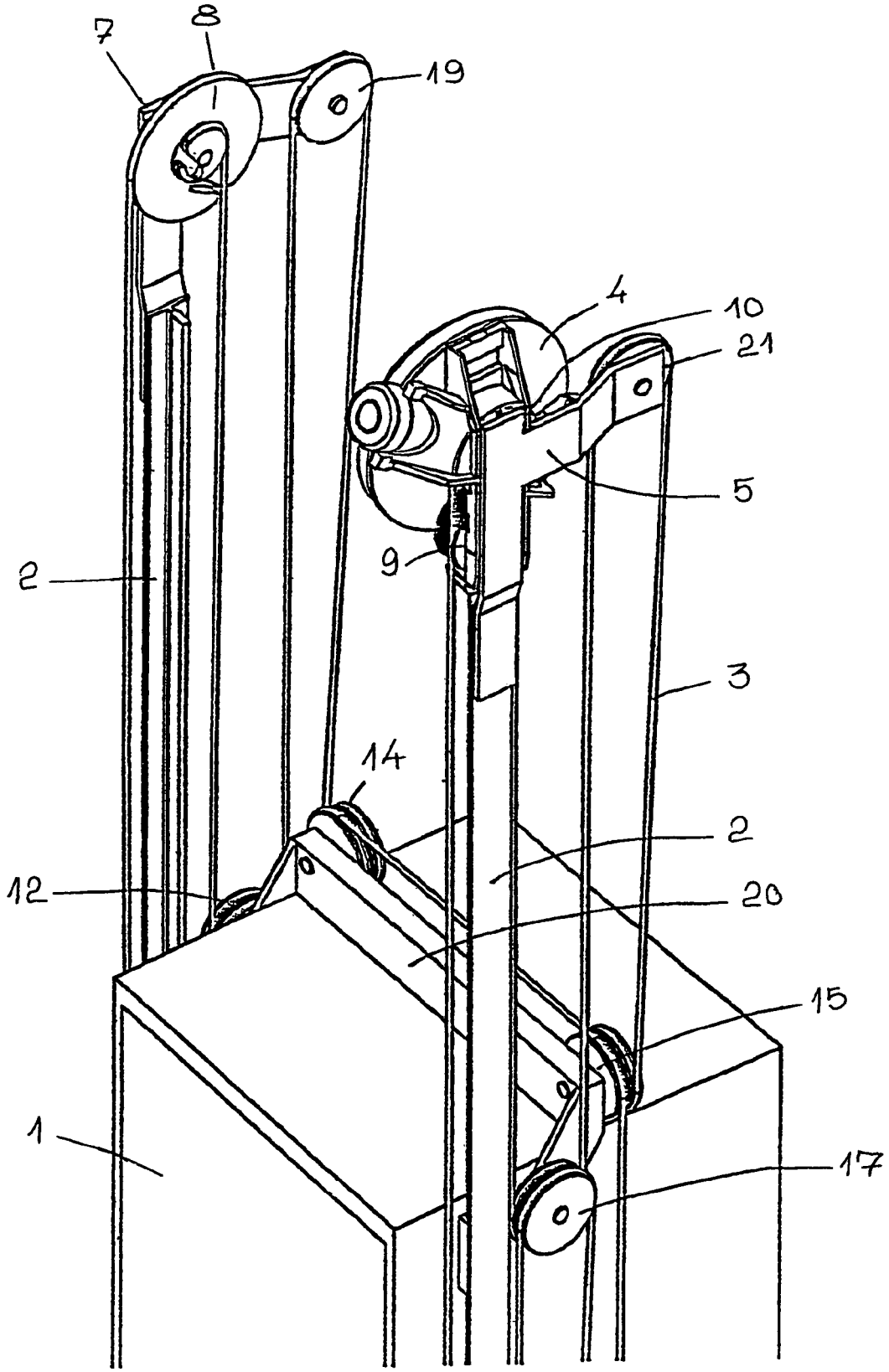
FIG. 2 is a diagram representing the elevator of FIG. 1 as seen from another angle.
Figure 3:
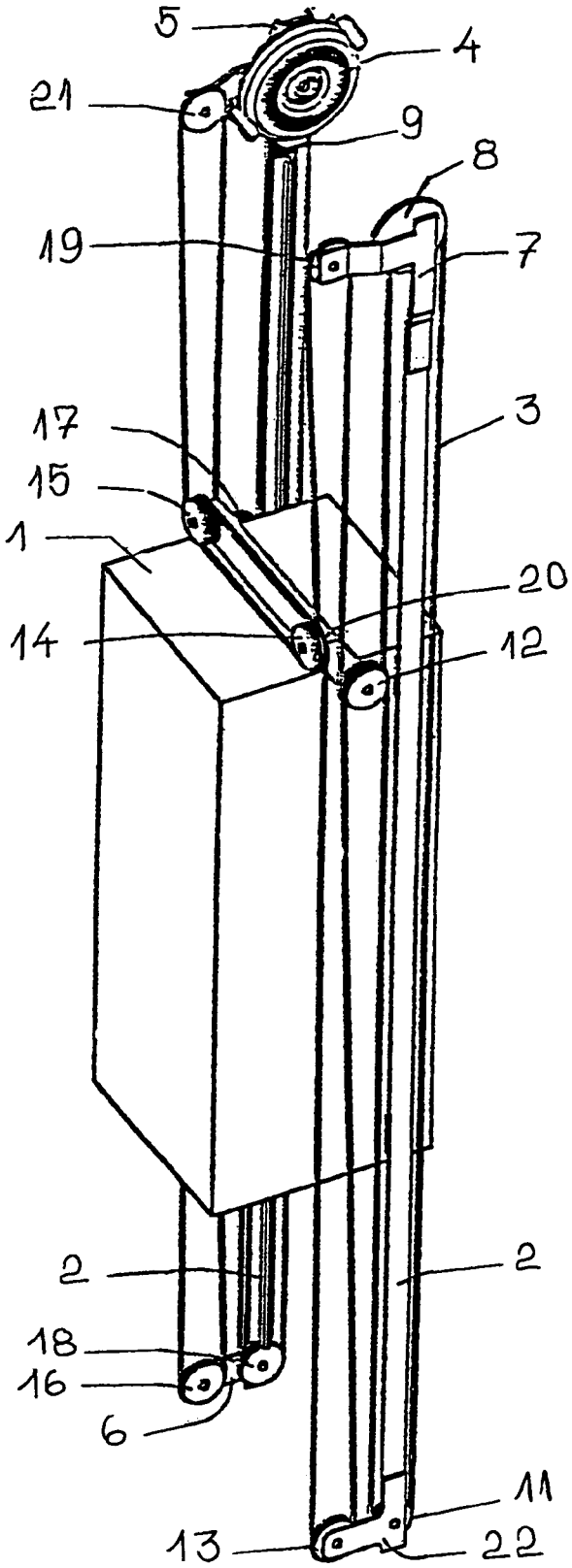
FIG. 3 is a diagram representing the elevator of FIGS. 1 and 2 as seen from a third angle.

FIGS. 1, 2, and 3 illustrate the structure of an elevator achieved by the invention. The elevator is preferably an elevator without machine room and with a drive machine 4 placed in the elevator shaft. The elevator presented in the figures is a traction sheave elevator without counterweight and with machine above, in which the elevator car 1 moves along guide rails 2. In FIGS. 1, 2, and 3, the hoisting ropes run as follows. One end of the hoisting ropes is fixed to a wheel of a smaller diameter comprised in a compensating gear functioning as a compensating device 8, said wheel being fixedly attached to a second wheel of a larger diameter comprised in the compensating gear 8. This compensating gear 8 functioning as a compensating device has been fitted to be fastened to the elevator shaft via a supporting element 7 immovably fixed to an elevator guide rail 2. The compensating gear is used, among other things, to adjust the difference of rope tension between the rope portions below and above the elevator car 1, or rather the mutual relationship between the rope tensions. From the compensating gear 8 wheel of smaller diameter, the hoisting ropes 3 go downwards to a diverting pulley 12 mounted on the elevator car 1, preferably on a beam 20 fitted in place in the upper part of the elevator car 1, and pass around the diverting pulley 12 along rope grooves provided in it. In the rope wheels used as diverting pulleys, these rope grooves may be coated or uncoated, e.g., with a friction-increasing material, such as polyurethane or some other appropriate material. From diverting pulley 12, the hoisting ropes 3 go further upwards to a diverting pulley 19 in the elevator shaft, said pulley being mounted in place on the supporting element 7, via which the diverting pulley 19 is mounted in place on the elevator guide rail 2. Having passed around diverting pulley 19, the hoisting ropes 3 go further downwards to a diverting pulley 14 which has also been fitted in place on a beam 20 fitted in place on the elevator car 1, preferably in the upper part of the elevator car 1. Having passed around diverting pulley 14, the hoisting ropes 3 go further transversely relative to the elevator shaft and elevator car 1 to a diverting pulley 15 mounted in place on the same beam 20 on the other side of the elevator car 1 and, after passing around this diverting pulley 15, the hoisting ropes 3 go further upwards to a diverting pulley 21 mounted in place in the upper part of the elevator shaft. Diverting pulley 21 has been fitted in place on a supporting element 5. Via the supporting element 5, the diverting pulley 21 is supported by the elevator guide rails 2. Having passed around diverting pulley 21, the hoisting ropes 3 go further downwards to a diverting pulley 17 mounted on the elevator car 1 and also fitted in place on the beam 20. Having passed around diverting pulley 17, the hoisting ropes 3 go further upwards to a diverting pulley 9 preferably mounted in place near the hoisting machine 4. Between diverting pulley 9 and the traction sheave 10, FIGS. 1, 2, and 3 show Double Wrap ("DW") roping. From diverting pulley 9, the hoisting ropes 3 go further to the traction sheave 10 after first passing via diverting pulley 9 in "tangential contact" with it. This means that the hoisting ropes 3 going from the traction sheave 10 to the elevator car 1 pass via the rope grooves of diverting pulley 9 and the deflection of the hoisting ropes 3 caused by the diverting pulley 9 is very small. It could be stated that the hoisting ropes 3 going from the traction sheave 10 only come into "tangential contact" with the diverting pulley 9. Such "tangential contact" functions as a solution for damping rope vibrations and it can also be applied in other roping solutions. The hoisting ropes 3 pass over the traction sheave 10 of the hoisting machine 4 along the rope grooves on the traction sheave 10. From the traction sheave 10, the hoisting ropes 3 go further downwards to diverting pulley 9, passing around it along the rope grooves of the diverting pulley 9 and returning back up to the traction sheave 10, over which the hoisting ropes 3 pass along the rope grooves of the traction sheave 10. From the traction sheave 10, the hoisting ropes 3 go further downwards in "tangential contact" with diverting pulley 9 past the elevator car 1 moving along the elevator guide rails 2 to a diverting pulley 18 placed in the lower part of the elevator shaft. The hoisting machine 4 and diverting pulley 9 are mounted in place on the supporting element 5, which in turn is fixed in place on the elevator guide rails 2. Diverting pulleys 12, 19, 14, 15, 21, 17, 9 and the wheel of smaller diameter comprised in the compensating gear 8, together with the traction sheave 10 of the hoisting machine 4, form the suspension above the elevator car 1, which has the same suspension ratio as the suspension below the elevator car 1, which in FIGS. 1, 2, and 3 has a suspension ratio of 6:1. The hoisting ropes 3 pass around diverting pulley 18 along rope grooves provided on it, which has been fitted in place preferably in the lower part of the elevator shaft on a supporting element 6 fixed in place to an elevator guide rail 2. Having passed around diverting pulley 18, the hoisting ropes 3 go further upwards to diverting pulley 17 fitted in place on the elevator car 1 and mounted on the beam 20 and, having passed around said diverting pulley 17, the hoisting ropes 3 go further downwards to a diverting pulley 16 in the lower part of the elevator shaft, which has been fitted in place on supporting element 6. Having passed around diverting pulley 16, the hoisting ropes 3 return to diverting pulley 15 fitted in place on the elevator car 1, said diverting pulley 15 being mounted on the beam 20. From diverting pulley 15, the hoisting ropes 3 go further transversely across the elevator car 1 to the diverting pulley 14 mounted in place on the beam 20 on the other side of the elevator car 1. Having passed around this diverting pulley 14, the hoisting ropes 3 go further downwards to a diverting pulley 13 fitted in place in the lower part of the elevator shaft, said diverting pulley 13 being mounted in place on a supporting element 22, which supporting element 22 in turn has been fixed in place to the elevator guide rail 2. Having passed around diverting pulley 13, the hoisting ropes 3 go further upwards to diverting pulley 12 fitted in place on the elevator car 1, said diverting pulley 12 being mounted on the beam 20. Having passed around diverting pulley 12, the hoisting ropes 3 go further downwards to a diverting pulley 11 mounted in place on a supporting element 22 in the lower part of the elevator shaft. Having passed around diverting pulley 11, the hoisting ropes 3 go further upwards to the compensating gear 8 mounted in place in the upper part of the shaft, the second end of the hoisting ropes 3 being fixed to the compensating gear 8 wheel of larger diameter. The compensating gear 8, functioning as a compensating device 8, is mounted in place on supporting element 7. Diverting pulleys 18, 17, 16, 15, 14, 13, 12, 11 and the wheel of larger diameter in the compensating gear 8, functioning as a compensating device 8, form the suspension below the elevator car 1, which has the same suspension ratio as the, suspension above the elevator car 1, this suspension ratio being 6:1 in FIGS. 1, 2, and 3.

In FIGS. 1, 2, and 3, the compensating gear 8 consists of two wheel-like bodies, preferably wheels, of different diameters and immovably fixed to each other, which compensating gear 8 has been fitted in place on the supporting element 7, which again is mounted in place on the elevator guide rails 2. Of the wheel-like bodies comprised in the compensating gear 8, the wheel connected to the hoisting ropes 3 below the elevator car 1 has a larger diameter than the wheel connected to the hoisting ropes 3 above the elevator car 1. The diameter ratio between the diameters of the wheels of the compensating gear defines the tensioning forces acting on the hoisting ropes 3 and therefore also the force of compensation of the elongations of the hoisting ropes 3 and at the same time the magnitude of the rope elongation to be compensated. The use of a compensating gear 8 provides the advantage that this structure will compensate even very large rope elongations. By varying the size of the diameters of the wheels of the compensating gear 8, it is possible to exert an influence on the magnitude of the rope elongation to be compensated and on the ratio between the rope forces $T_1$ and $T_2$ acting over the traction sheave, which ratio can be standardized by the arrangement in question. Due to a large suspension ratio or a large hoisting height, the length of the hoisting ropes 3 used in the elevator is large. Therefore, it is essential for the operation and safety of the elevator that the hoisting rope portion below the elevator car 1 is held under a sufficient tension and that the amount of rope elongation to be compensated is large. Often this can not be implemented using a spring or a simple lever. With odd suspension ratios above and below the elevator car 1, the compensating gear functioning as a compensating device in the elevator depicted in FIGS. 1, 2, and 3 has been fitted in place on the elevator car 1 by means of a transfer gear, and with even suspension ratios the compensating gear functioning as a compensating device in the elevator of the invention has been fitted in place in the elevator shaft, preferably on the elevator guide rails 2. In the compensating gear 8 of the invention it is possible to use wheels, the number of which is two, but the number of wheel-like bodies used may vary, for example it is possible to use only one wheel with hoisting rope fixing points fitted on it at different positions regarding the diameter. It is also possible to use more than two wheels if it is desirable, e.g., to vary the ratio between the diameters of the wheels by only changing the diameters of the wheels in the compensating gear. The elevator without counterweight presented in FIGS. 1, 2, and 3 is not provided with traditional springs for compensating the rope forces, but instead it uses a compensating gear 8 as a compensating device. Consequently, the ropes comprised in the set of hoisting ropes 3 can be secured directly to the compensating gear 8. Besides a compensating gear 8 as presented in the figures, the compensating device 8 of the invention may also consist of a suitable lever or other appropriate compensating device with several compensating wheels. The beam 20 presented in the figures which is fixed in place in conjunction with the elevator car 1 may also be mounted elsewhere than in the place above the elevator car 1 as shown in the figures. It may also be placed, e.g., below the elevator car 1 or somewhere between these positions. The diverting pulleys may have a plurality of grooves and the same diverting pulley can be used to guide both the passage of the hoisting ropes 3 comprised in the suspension above the elevator car 1 and the passage of the hoisting ropes comprised in the suspension below the elevator car 1, as illustrated e.g., in the figures in connection with diverting pulleys 12, 14, 15, 17.

A preferred embodiment of the elevator of the invention is an elevator without counterweight and with machine above, which elevator has a drive machine with a coated traction sheave and thin hoisting ropes of a substantially round cross-section. The contact angle of the hoisting ropes on the traction sheave of the elevator is greater than 180°. The elevator comprises a unit comprising the drive machine, the traction sheave and a diverting pulley, all fitted in place by means of a supporting element, the diverting pulley being ready fitted in a correct angle relative to the traction sheave. This unit is secured to the elevator guide rails. The elevator is implemented without counterweight with a suspension ratio of 6:1. The compensation of rope forces and elongations is implemented using a compensating device according to the invention. The diverting pulleys in the elevator shaft are fitted in place by means of supporting elements on the elevator guide rails and the diverting pulleys on the elevator car are all mounted in place on the beam on the elevator car, said beam also forming a structure bracing the elevator car.

The elevator car 1 is suspended on the hoisting ropes via the beam 20 and the diverting pulleys mounted on the beam. The beam 20 is part of the load-bearing structure of the elevator car, which may be in the form of a self-supporting car or a framework of beams or the like joined or integrated to the elevator car. The elevator is preferably installed by first rigging the ropes and only then completing the elevator car, because some structures of the completed elevator car may impede installation. The floor 24 of the elevator car 1 can be initially placed as a working platform. The diverting pulleys in the upper part of the elevator shaft are mounted in place by utilizing the elevator car or otherwise. The diverting pulleys of the elevator car are hoisted together with the beam 20 to a distance from the floor 24 of the elevator car and the elevator car 1 is assembled by joining the walls 25 to the floor and mounting the beam 20 and the ceiling 23 in the upper part of the elevator car. After the hoisting ropes have been mounted on the diverting pulleys in the upper or lower part of the elevator shaft, the diverting pulleys in the upper part of the elevator shaft and on the elevator car, or respectively the diverting pulleys in the lower part of the elevator shaft and on the elevator car, can be moved further away from each other while at the same time supplying more rope into the elongating roping, whereupon the rope portions in the other end of the shaft are rigged.

Figure 4:
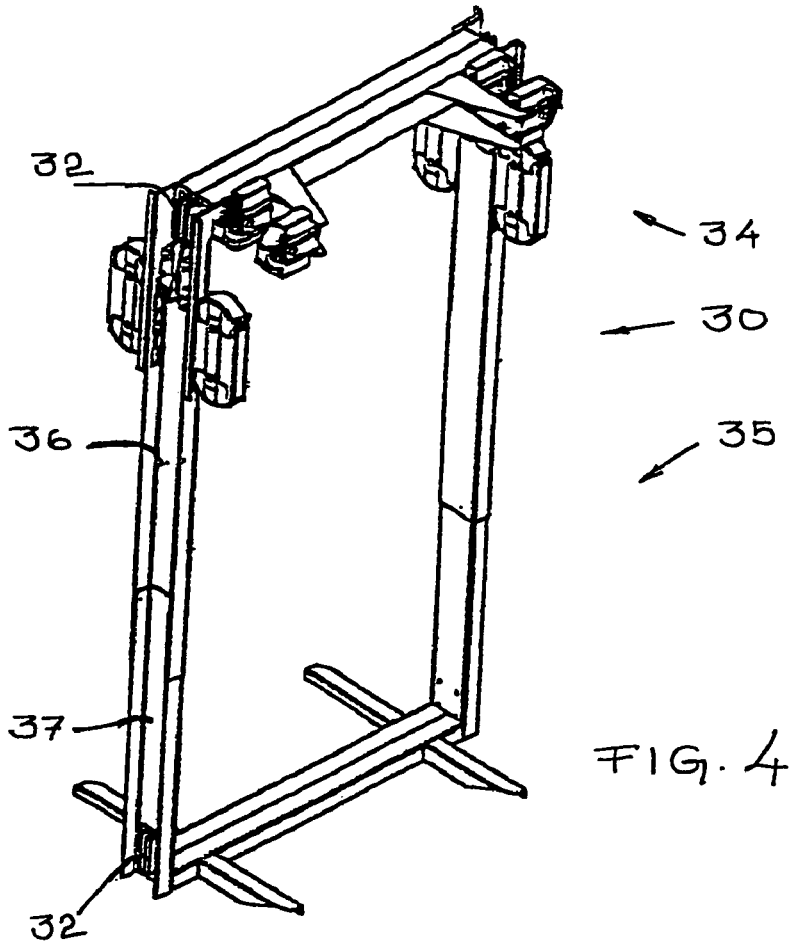
FIG. 4 presents a car supporting frame according to the invention, extended to a height at which the car can be installed in the frame.
Figure 5:
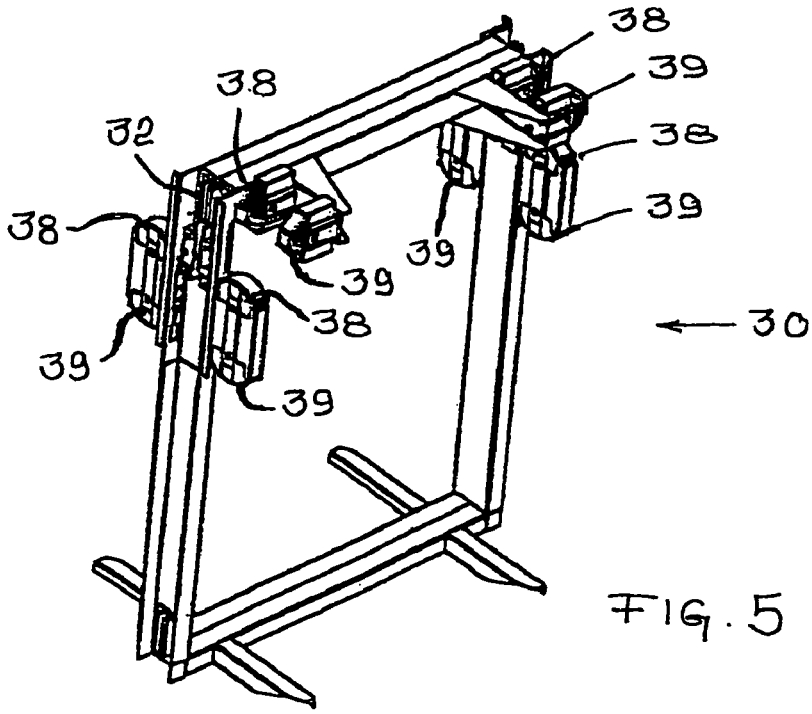
FIG. 5 presents the car supporting frame of the invention in a collapsed form.
Figure 6:
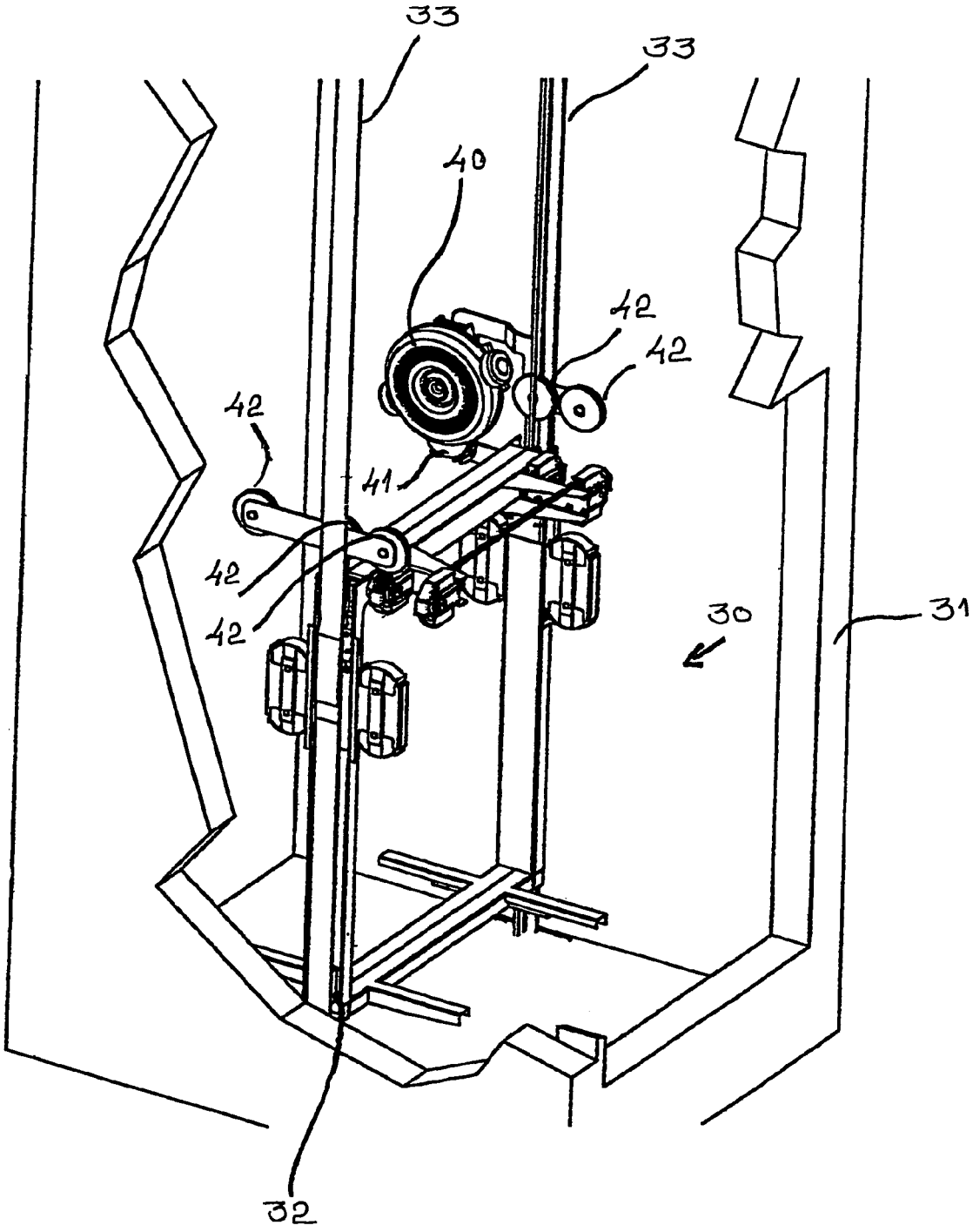
FIG. 6 presents the car supporting frame of the invention on the bottom of the shaft.
Figure 7:
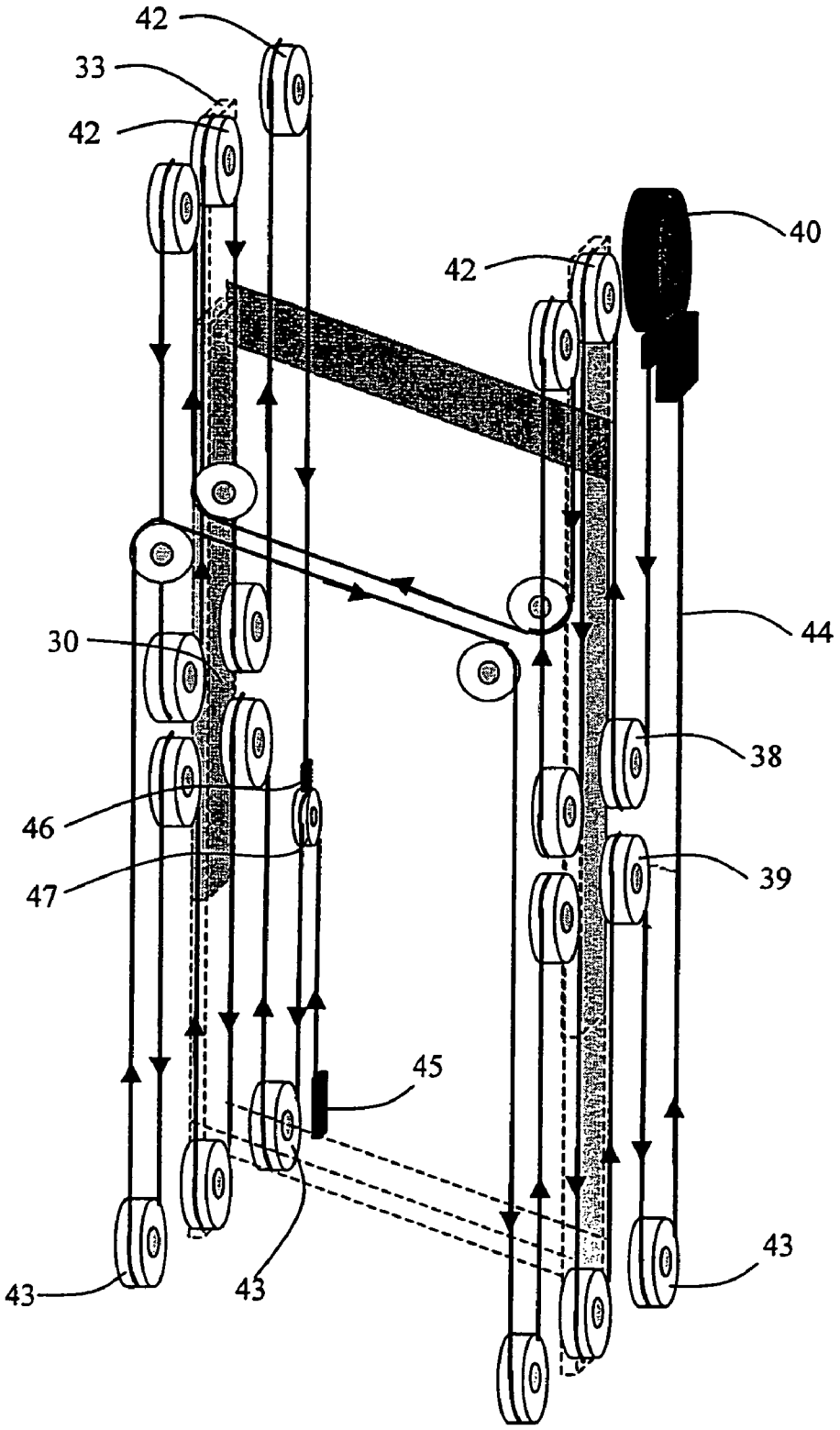
FIG. 7 is a diagrammatic representation of rope rigging implemented according to the invention.
Figure 8:
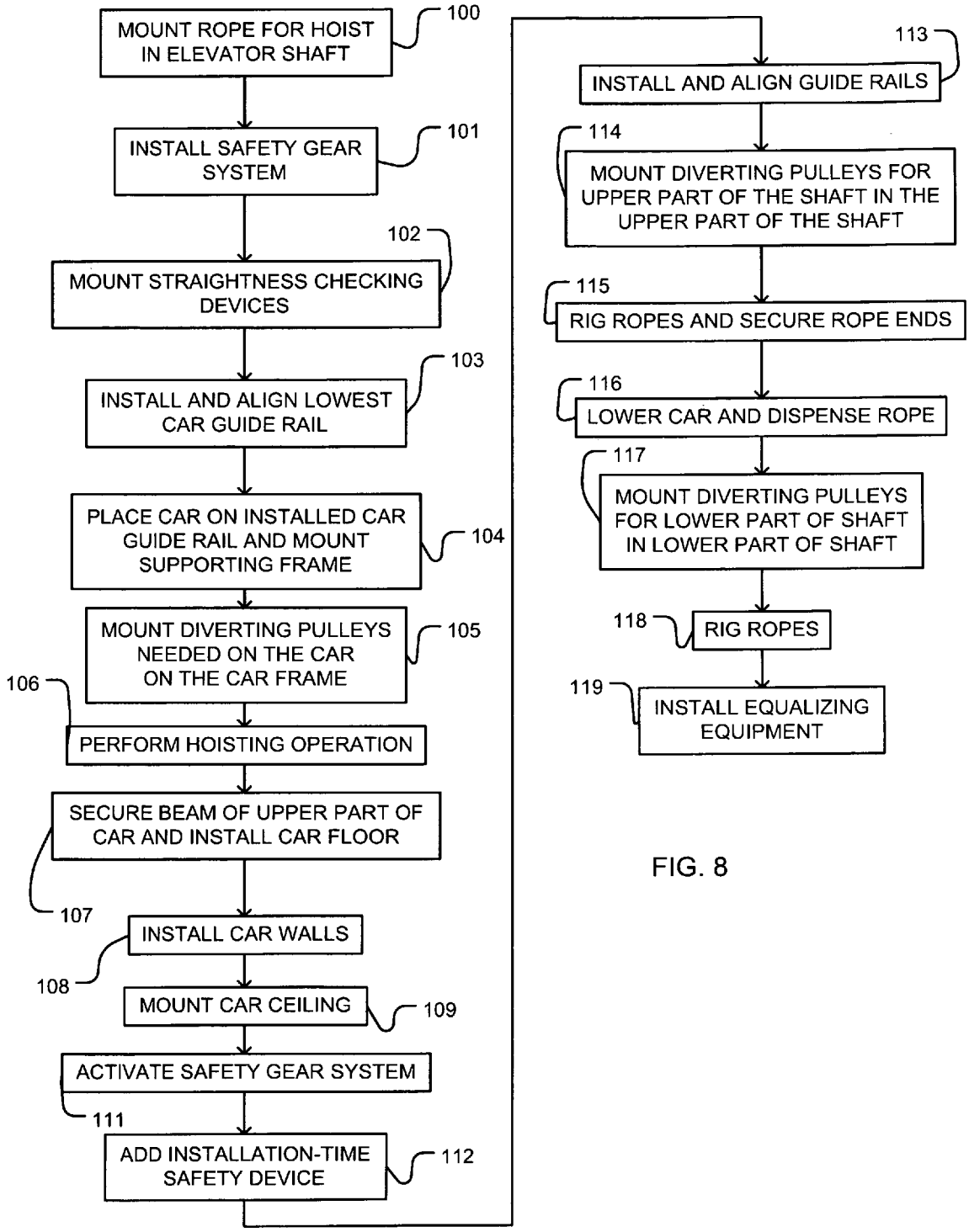
FIG. 8 is a flow chart illustrating a method according to an example embodiment.

FIG. 7 illustrates how the ropes of an elevator implemented according to the invention are passed over different diverting pulleys and rope pulleys of the hoisting machine, and FIGS. 4, 5, and 6 show the car supporting frame 30, which in FIG. 4 is presented in a length in which the elevator car 1 can be installed inside the frame while FIG. 5 presents it in a collapsed or lower form that makes the frame easy to transport, as far as the frame is transported as a complete assembly, with diverting pulleys mounted on it, allowing the ropes to be easily passed to them. FIGS. 4 and 5 do not show the diverting pulleys in the upper and lower parts of the elevator shaft. FIG. 6 presents the car supporting frame 30 in a situation where the frame is on the bottom of the elevator shaft 31. The car supporting frame 30 is provided with guides 32, by means of which the elevator car 1 is positioned and controlled as it is moving vertically along the elevator guide rails 33. The upper part 34 and lower part 35 of the car supporting frame 30 are telescopically joined together by beam sections 36 and 37 of the side beams of the car supporting frame 30. The telescopic or otherwise variable-length joining together of the upper and lower parts can also be implemented in other ways. The car supporting frame 30 is provided with diverting pulleys intended for the suspension of the elevator car 1 on the hoisting ropes 3, comprising a first set of diverting pulleys 38, from which the ropes of the set of hoisting ropes 3 go upwards, and a second set of diverting pulleys 39, from which the ropes of the set of hoisting ropes 3 go downwards. FIG. 6 shows the diverting pulleys 42 to be installed in the upper part of the shaft but which are temporarily mounted on the car supporting frame 30, the hoisting machine 40 with a traction sheave (not shown) and preferably an auxiliary diverting pulley 41, which allows the roping on the machine to be implemented as so-called Double Wrap roping or the contact angle between the traction sheave and the hoisting ropes 3 to be changed in other ways, and the diverting pulleys 43 to be installed in the lower part of the elevator shaft. Attached to the car supporting frame 30 are preferably other parts of the elevator car 1, such as the car floor 24, which can thus be used as a working platform. In conjunction with the car supporting frame 30 or separately from it, the required amount of hoisting rope for the set of hoisting ropes is delivered on reels to the elevator shaft or to a place near it. The reels are not shown in the figure. In FIG. 7, the set of hoisting ropes 44 is depicted diagrammatically as a single rope with arrowheads indicating the passage of the rope, starting from the rope end fixing point 45 in the lower part of the shaft and finally ending up at a rope force differentiating arrangement 46, which consists of a tackle system designed to maintain the relative rope tension difference between the rope portions above and below the elevator car 1. The rope force differentiating arrangement 46 can also be implemented in other ways, which may involve a different solution regarding the fixing of the rope ends. Starting from the fixing point 45, the ropes go first to a rope wheel 47 comprised in the differentiating arrangement 46, then continuing first to the diverting pulley 43 in the lower part of the shaft, from where the rope goes further to a down-direction diverting pulley 39 of the elevator car 1 and further, passing one by one over the diverting pulleys in the lower part of the shaft and the down-direction diverting pulleys of the elevator car 1, until from the last diverting pulley in the lower part of the shaft the ropes go up to the machine 40. From the machine 40, the ropes run further to the first up-direction diverting pulley 38 of the elevator car 1, passing by turns over the diverting pulleys 42 in the upper part of the shaft and each up-direction diverting pulley 38 until from the last diverting pulley in the upper part of the shaft the ropes terminate at the rope force differentiating arrangement 46.

It is obvious to the person skilled in the art that different embodiments of the invention are not limited to the examples described above, but that they may be varied within the scope of the claims presented below. For example, the number of times the hoisting ropes are passed between the diverting pulleys in the upper part of the elevator shaft and those on the elevator car and between the diverting pulleys in the lower part of the elevator shaft and those on the elevator car is not a very decisive question as regards the basic advantages of the invention, although it is possible to achieve some additional advantages by using multiple and even numbers of rope portions. It is also obvious to the skilled person that an embodiment according to the invention can also be implemented using odd suspension ratios above and below the elevator car, in which case the compensating device is mounted in conjunction with the elevator car or its structures. In accordance with the examples described above, a skilled person can vary the embodiment of the invention as the traction sheaves and rope pulleys, instead of being coated metal pulleys, may also be uncoated metal pulleys or uncoated pulleys made of some other material suited to the purpose.

It is further obvious to the person skilled in the art that the metallic traction sheaves and rope wheels used as diverting pulleys in the invention, which are coated with a non-metallic material at least in the area of their grooves, may be implemented using a coating material consisting of e.g. rubber, polyurethane or some other material suited to the purpose.

It is also obvious to the person skilled in the art that the elevator car and the machine unit may be laid out in the cross-section of the elevator shaft in a manner differing from the lay-out described in the examples. The skilled person also understands that 'elevator car' may refer to a self-supporting car structure, an assembly consisting of an elevator car and a car supporting frame, or also a car structure mounted inside a car supporting frame.

It is obvious to the skilled person that an elevator applying the invention may be equipped differently from the examples described above. It is further obvious to the skilled person that the elevator of the invention can be implemented using as hoisting ropes almost any flexible hoisting means, e.g. a flexible rope of one or more strands, a flat belt, a cogged belt, a trapezoidal belt or some other type of belt suited to the purpose.

It is further obvious to the skilled person that the elevator of the invention may also be provided with a counterweight, in which case the counterweight of the elevator preferably has a weight below that of the car and is suspended by a separate set of ropes. The skilled person understands that a regular elevator shaft surrounding the elevator car from all sides is not strictly necessary for the elevator, provided that sufficient safety and protection of the technical parts are achieved.

The invention claimed is:

1. A method for installing an elevator, the elevator to be installed including elevator car guide rails, an elevator car or partially completed elevator car, a hoisting rope or two or more parallel hoisting ropes, a traction sheave configured to be disposed in a first location that is fixed relative to an elevator shaft of the elevator, a compensating system configured to be disposed in a second location that is fixed relative to the elevator shaft, a plurality of first diverting pulleys in an upper part of the elevator shaft, a plurality of second diverting pulleys in a lower part of the elevator shaft, a plurality of third diverting pulleys on the elevator car or partially completed elevator car, and a plurality of fourth diverting pulleys on the elevator car or partially completed elevator car, the method comprising:

stopping the elevator car or partially completed elevator car in the upper part of the elevator shaft;

rigging first rope portions of the hoisting rope or two or more parallel hoisting ropes between the elevator car or partially completed elevator car and the first diverting pulleys, while the elevator car or partially completed elevator car is stopped in the upper part of the elevator shaft, so that the first rope portions pass via the first diverting pulleys and the third diverting pulleys;

moving the elevator car or partially completed elevator car to the lower part of the elevator shaft, while at the same time supplying ropes from rope reels to the first rope portions between the elevator car or partially completed elevator car and the first diverting pulleys, wherein the first rope portions become longer due to moving the elevator car or partially completed elevator car; and rigging second rope portions of the hoisting rope or two or more parallel hoisting ropes between the elevator car or partially completed elevator car and the second diverting pulleys, while the elevator car or partially completed elevator car is stopped in the lower part of the elevator shaft, so that the second rope portions pass via the second diverting pulleys and the fourth diverting pulleys;

wherein, when installed, the traction sheave moves the elevator car using the hoisting rope or two or more parallel hoisting ropes, wherein, when installed, the compensating system causes a first rope tension in the first rope portions, wherein, when installed, the compensating system causes a second rope tension in the second rope portions, wherein, when installed, the compensating system compensates rope elongations in the first and second rope portions so as to maintain a ratio of the first rope tension to the second rope tension substantially constant, and wherein, when installed, the plurality of first diverting pulleys are mounted directly to the elevator car guide rails or each of the plurality of first diverting pulleys is mounted to the elevator car guide rails via a separate supporting element.

2. The method of claim 1, wherein the elevator car guide rails are installed before rigging the first rope portions.

3. The method of claim 2, wherein lowest sections of the elevator car guide rails are installed in the elevator shaft first, wherein the elevator car or partially completed elevator car is mounted in place so that the elevator car or partially completed elevator car can be guided by the elevator car guide rails, wherein the elevator car or partially completed elevator car is raised using a hoist in the elevator shaft, and wherein remaining elevator car guide rails are installed using the elevator car or partially completed elevator car as a working platform.

4. An elevator installed according to the method of claim 1, wherein when installing the elevator is completed, the traction sheave is operatively attached to a first of the elevator car guide rails.

5. The elevator of claim 4, wherein the elevator further includes a telescopic car supporting frame.

6. The elevator of claim 4, wherein the elevator is an elevator without machine room.

7. The elevator of claim 4, wherein the elevator is an elevator without counterweight.

8. The method of claim 1, wherein the elevator to be installed is an elevator without counterweight.

9. An elevator installed according to the method of claim 8, wherein when installing the elevator is completed, the compensating system is operatively attached to a first of the elevator car guide rails.

10. The method of claim 1, wherein the elevator car guide rails are installed using the partially completed elevator car, the elevator car, or the partially completed elevator car and the elevator car.

11. The method of claim 1, wherein the first diverting pulleys are hoisted to the upper part of the elevator shaft using the elevator car or partially completed elevator car.

12. The method of claim 1, the elevator to be installed further including:

a drive machine;

wherein the drive machine is hoisted to the upper part of the elevator shaft together with the first diverting pulleys and mounted in place, and wherein the hoisting rope or two or more parallel hoisting ropes are mounted on a traction sheave of the drive machine while the elevator car or partially completed elevator car is stopped to allow the first diverting pulleys to be rigged.

13. The method of claim 1, wherein the elevator to be installed is an elevator without machine room.

14. The method of claim 1, wherein the hoisting rope or the two or more parallel hoisting ropes pass above the elevator car only directly between the plurality of third diverting pulleys and the plurality of fourth diverting pulleys, and wherein the plurality of third diverting pulleys and the plurality of fourth diverting pulleys are fixed to a beam, which is fixed to a top side of the elevator car, the beam extending between the car guide rails.

15. A method for installing an elevator, the elevator to be installed including elevator car guide rails, an elevator car or partially completed elevator car, a hoisting rope or two or more parallel hoisting ropes, a traction sheave configured to be disposed in a first location that is fixed relative to an elevator shaft of the elevator, a compensating system configured to be disposed in a second location that is fixed relative to the elevator shaft, a plurality of first diverting pulleys in an upper part of the elevator shaft, a plurality of second diverting pulleys in a lower part of the elevator shaft, a plurality of third diverting pulleys on the elevator car or partially completed elevator car, and a plurality of fourth diverting pulleys on the elevator car or partially completed elevator car, the method comprising:

stopping the elevator car or partially completed elevator car in the lower part of the elevator shaft;

rigging second rope portions of the hoisting rope or two or more parallel hoisting ropes between the elevator car or partially completed elevator car and the second diverting pulleys, while the elevator car or partially completed elevator car is stopped in the lower part of the elevator shaft, so that the second rope portions pass via the second diverting pulleys and the fourth diverting pulleys;

moving the elevator car or partially completed elevator car to the upper part of the elevator shaft, while at the same time supplying ropes from rope reels to the second rope portions between the elevator car or partially completed elevator car and the second diverting pulleys, wherein the second rope portions become longer due to moving the elevator car or partially completed elevator car; and rigging first rope portions of the hoisting rope or two or more parallel hoisting ropes between the elevator car or partially completed elevator car and the first diverting pulleys, while the elevator car or partially completed elevator car is stopped in the upper part of the elevator shaft, so that the first rope portions pass via the first diverting pulleys and the third diverting pulleys;

wherein, when installed, the traction sheave moves the elevator car using the hoisting rope or two or more parallel hoisting ropes, wherein, when installed, the compensating system causes a first rope tension in the first rope portions, wherein, when installed, the compensating system causes a second rope tension in the second rope portions, wherein, when installed, the compensating system compensates rope elongations in the first and second rope portions so as to maintains a ratio of the first rope tension to the second rope tension substantially constant, and wherein, when installed, the plurality of first diverting pulleys are mounted directly to the elevator car guide rails or each of the plurality of first diverting pulleys is mounted to the elevator car guide rails via a separate supporting element.

16. An elevator installed according to the method of claim 15, wherein when installing the elevator is completed, the traction sheave is operatively attached to a first of the elevator car guide rails.

17. The elevator of claim 16, wherein the elevator further includes a telescopic car supporting frame.

18. The elevator of claim 16, wherein the elevator is an elevator without machine room.

19. The elevator of claim 16, wherein the elevator is an elevator without counterweight.

20. The method of claim 15, wherein the elevator to be installed is an elevator without counterweight.

21. An elevator installed according to the method of claim 20, wherein when installing the elevator is completed, the compensating system is operatively attached to a first of the elevator car guide rails.

22. The method of claim 15, wherein the elevator to be installed is an elevator without machine room.

* * * * *